US005871154A

United States Patent [19]

Hardy

[11] Patent Number: 5,871,154

[45] Date of Patent: Feb. 16, 1999

[54] FUEL INJECTION SYSTEM

[75] Inventor: Martin Paul Hardy, Gillingham, Great Britain

[73] Assignee: Lucas Industries,plc, England

[21] Appl. No.: 845,005

[22] Filed: Apr. 22, 1997

[30] Foreign Application Priority Data

May 3, 1996 [GB] United Kingdom ..... 9609382

[51] Int. Cl.[6] ..... F02M 47/02

[52] U.S. Cl. ..... 239/88; 239/91; 239/584

[58] Field of Search ..... 239/88–92, 533.1, 239/533.2, 533.3, 533.9, 583, 584

[56] References Cited

U.S. PATENT DOCUMENTS

| | | | |
|---|---|---|---|
| 4,928,886 | 5/1990 | Kronberger . | |
| 4,969,600 | 11/1990 | Nicol | 239/88 |
| 5,335,852 | 8/1994 | Muntean et al. | 239/89 |
| 5,538,187 | 7/1996 | Mueller et al. | 239/88 |
| 5,632,444 | 5/1997 | Camplin et al. | 239/88 |
| 5,673,853 | 10/1997 | Crofts et al. | 239/88 |

FOREIGN PATENT DOCUMENTS

| | | |
|---|---|---|
| 2 105 406 | 3/1983 | United Kingdom . |
| 2 140 505 | 11/1984 | United Kingdom . |

*Primary Examiner*—Andres Kashnikow
*Assistant Examiner*—Lisa Ann Douglas
*Attorney, Agent, or Firm*—Andrus, Sceales, Starke & Sawall

[57] ABSTRACT

A fuel injection system comprises a pumping plunger slidable within a bore and arranged to supply fuel to an injector nozzle. A spill valve communicates with the bore to control the fuel pressure applied to the nozzle. The nozzle includes a valve member biased into engagement with a seating by a spring, the spring engaging a piston member at least part of the end of which remote from the spring is exposed to the fuel pressure in the bore. The spill valve includes a flow connection which communicates by way of a restrictor with a drain. The restrictor is formed by the piston member and cylinder within which the piston member is slidable.

5 Claims, 1 Drawing Sheet

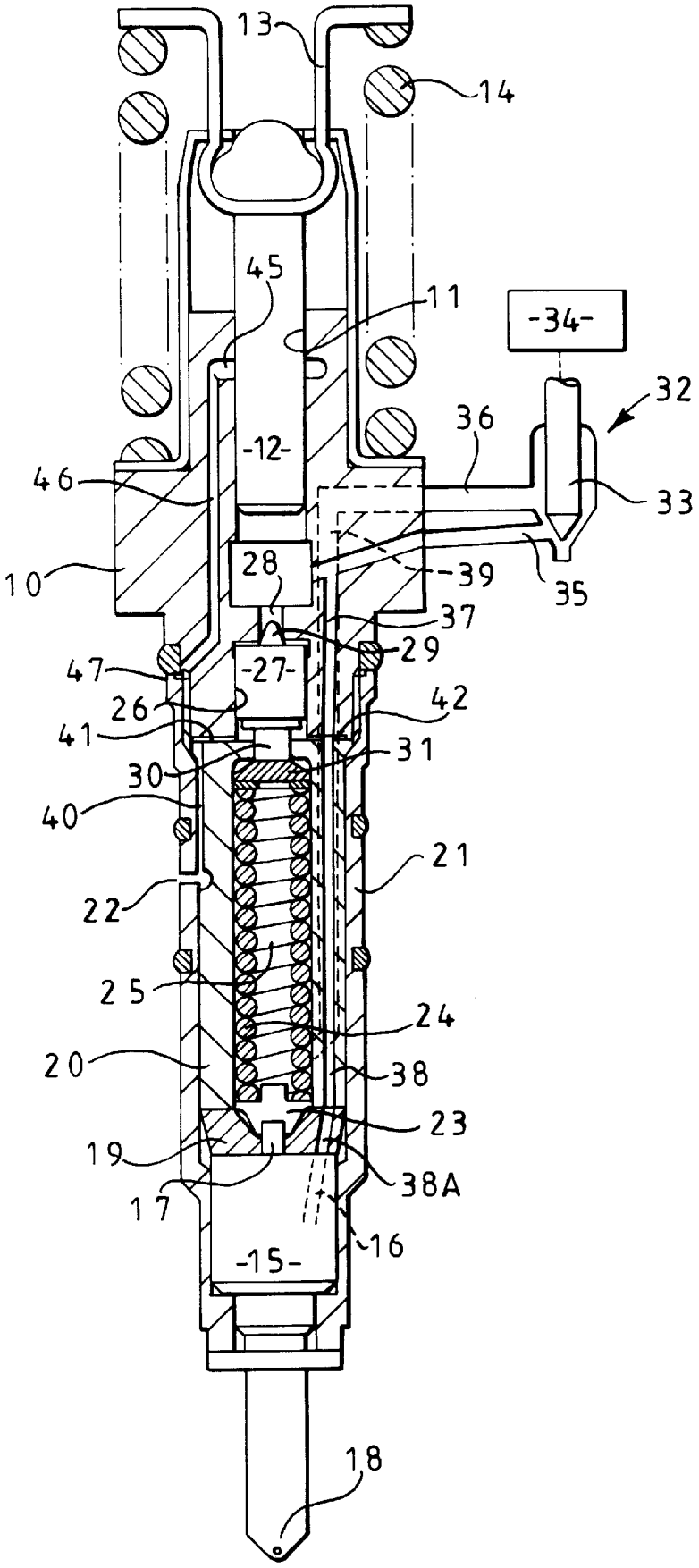
13
14
45
11
-34-
32
36
-12-
46
33
28
39
10
35
37
29
47
-27-
42
26
41
31
30
40
21
22
25
24
20
38
23
19
38A
17
16
-15-
18

FUEL INJECTION SYSTEM

This invention relates to a fuel injection system for supplying fuel to a cylinder of an internal combustion engine, the system comprising a pumping plunger slidable in a bore, the plunger in use being urged inwardly towards one end of said bore to displace fuel therefrom, by an engine driven cam, a fuel injection nozzle including a fuel pressure actuated valve member which is lifted from a seating by the action of fuel under pressure in a nozzle inlet passage thereby to allow flow of fuel from said passage through an outlet, said passage communicating with said one end of the bore, a spring biasing the valve member into engagement with the seating, a piston member slidable within a cylinder and serving as an abutment for said spring, a further passage opening into the one end of the cylinder remote from the spring, said passage communicating with said one end of the bore, said piston member being movable from a first position at said one end of the cylinder to a second position at the other end of the cylinder to increase the force exerted by the spring on the valve member, and valve means operable by the piston member which limits the end area of the piston member exposed to the fuel pressure in said further passage when the piston member is in the first position and a spill valve having a first flow connection to said one end of the bore and a second flow connection to a drain.

The system as described above is well known in the art and provides for a pilot quantity of fuel to be delivered to the engine cylinder in advance of the main quantity of fuel.

Following closure of the spill valve with the plunger moving inwardly, the fuel pressure in the one end of the bore increases and the valve member of the fuel injection nozzle lifts from its seating to allow fuel flow through the outlet. As the fuel pressure increases further the piston member moves from its first position to its second position and in so doing increases the force exerted by the spring on the valve member of the fuel injection nozzle. In addition, the movement of the piston member increases the high pressure working volume so that the pressure of fuel supplied to the nozzle inlet passage falls. The practical effect is that the valve member of the nozzle closes thereby interrupting the flow of fuel through the outlet. The valve member of the nozzle is again lifted from its seating as the fuel pressure increases to a higher value so as to allow the main quantity of fuel to be supplied to the engine. The flow of fuel to the engine ceases when the spill valve is opened to allow the fuel pressure in the nozzle inlet passage to fall. The spring acts to return the valve member of the nozzle into engagement with the seating and also returns the piston member to its first position.

The object of the present invention is to provide a system of the kind specified in a simple and convenient form.

According to the invention the second flow connection of the spill valve is connected to the drain by way of a restrictor which is formed by the piston member and the cylinder when the piston member is in the second position, the fuel pressure which is developed between the spill valve and the restrictor when the spill valve is opened, being applied to the valve member of the fuel injection nozzle in order to assist the action of the spring.

An example of a fuel injection system in accordance with the invention will now be described with reference to the accompanying drawing which is a part sectional side elevation of a pump/injector for an automobile compression ignition engine.

BRIEF DESCRIPTION

FIG. 1 A part sectional side elevation of a pump injector

The pump/injector comprises a stepped body 10 in which is formed a plunger bore 11 extending out of which is a pumping plunger 12. The outer end of the plunger is provided with a head with which is engaged a flanged spring abutment 13. A return spring 14 is interposed between the flange of the abutment 13 and the body 10. The plunger 12 is movable inwardly against the action of the spring by an engine driven cam.

The pump/injector includes a fuel injection nozzle 15 which is of conventional type including a fuel pressure actuated inwardly opening valve member which is movable away from a seating by the action of fuel under pressure in a nozzle inlet passage 16 to allow fuel flow from the passage 16 through an outlet orifice 18. The body of the nozzle is of the usual stepped form and is held in sealing engagement with a distance piece 19 which in turn is held in sealing engagement with a spring housing 20. The spring housing in turn is held in sealing engagement with the body 10. The nozzle body, the distance piece, the spring housing and the body 10 are held in assembled relationship by a cap nut 21 which is in screw thread engagement with the body 10. The skirt of the cap nut is provided with a fuel inlet 22 and on opposite sides of the inlet sealing rings are provided which provide fuel tight seals with the wall of the bore in the engine cylinder head.

The nozzle valve member is provided with an extension 17 which extends with clearance through an opening in the distance piece 19 and it carries a spring abutment 23 which is engaged by one end of a coiled compression spring 24. The spring 24 is housed within a spring chamber 25 formed in the spring housing 20.

In the end face of the body 10 which is presented to the spring housing 20 there is formed a cylinder 26 in which is slidably mounted a piston member 27. A passage 28 opens into the one end wall of the cylinder remote from the spring housing and this passage communicates with the inner end of the bore 11. The one end of the wall of the cylinder 26 defines a seating about the passage 28 and the seating is engagable by a projection 29 formed on the piston member, the projection and seating forming a valve means as will be explained. The opposite end of the cylinder 26 is partly closed by the adjacent end face of the spring housing 20 but this end face is provided with an opening through which extends a peg 30 formed integrally with the piston member. The peg 30 is engaged by a spring abutment 31 engaged through a shim with the adjacent end of the spring 25.

The pump/injector also includes a spill valve 32 which is secured to the body 10 and which includes a valve member 33 movable into engagement with a seating against the action of a spring when electric current is supplied to an actuator 34. The spill valve has first and second flow connections 35, 36 and the first of these is connected to the inner end of the bore 11 and also to the nozzle inlet passage 16 by way of passages 37 and 38 formed in the body 10 and spring housing respectively, the passage 38 having an extension 38A in the distance piece 19. These passages are shown in full outline in the drawing.

The second flow connection 36 of the spill valve is connected by a passage 39 which is shown in dotted outline, with the spring chamber 25. This passage traverses the joint formed by the presented faces of the body 10 and the spring housing 20. Formed in one of these presented faces is a pair of grooves 41, 42. The groove 41 extends between the adjacent end of the cylinder 26 and a groove 40 which is formed in the outer surface of the spring housing 20 and which connects with the fuel inlet 22. The groove 42 extends between the adjacent end of the cylinder 26 and the passage 39. Moreover, the end of the piston member adjacent the end of the spring housing is stepped so as to form when the piston member is in engagement with the spring housing as will be explained, a restriction interconnecting the grooves 41, 42.

In operation, and starting with the various parts of the pump/injector in the positions shown in the drawing, delivery of fuel to the engine cylinder takes place when during inward movement of the pumping plunger 12, the spill valve 32 is closed. Prior to closure of the spill valve, the fuel displaced by the pumping plunger flows through the spill valve to the passage 39 and by way of the groove 42, the cylinder 26, and the grooves 41 and 40 to the fuel inlet. Since the piston member is in its first or seated position there is substantially no restriction to the fuel flow.

When the spill valve 32 is closed, the fuel flow described above ceases and the fuel pressure in the inner end of the bore and the connected passages starts to increase. In particular the pressure of fuel applied to the valve member of the fuel injection nozzles increases and when the pressure rises to a sufficiently high value the valve member moves against the action of the spring 24 and fuel flow takes place through the outlet orifice 18. The end area of the projection 29 which is exposed to the high fuel pressure in the passage 28 will usually be less than the area of the nozzle valve member which is exposed to the high fuel pressure so that the valve member is lifted from its seating before there is any movement of the projection and piston member. As the fuel pressure continues to increase the force acting on the projection increases and eventually the projection is lifted from its seating to allow the high fuel pressure to act on the whole end face of the piston member. This causes rapid movement of the piston member to its second or retracted position in which it engages the end face of the spring housing 20.

The movement of the piston member 27 to its retracted position increases the force exerted by the spring 24 on the valve member of the nozzle and it also has the effect of increasing the working volume of the high pressure fuel thereby lowering the pressure of fuel at the fuel injection nozzle. The practical effect is that the valve member of the fuel injection nozzle returns to its closed position and only opens again when the fuel pressure increases to a value which is higher due to the added spring force, than that required to effect the initial movement of the valve member. The flow of fuel through the outlet orifice 18 continues so long as the spill valve remains closed and the pumping plunger is moving inwardly.

In order to terminate delivery of fuel to the engine cylinder, the spill valve 32 is opened and this allows fuel under pressure to flow into the passage 39 and into the spring chamber. This flow of fuel reduces the pressure of fuel at the inlet of the nozzle but in addition, it raises the pressure of fuel in the spring chamber 25. The force acting to hold the valve member in the open position is therefore reduced but in addition the spring force acting to urge the valve member onto its seating is supplemented by the force developed by the fuel pressure acting on the end of the valve member. The valve member is therefore moved quickly onto its seating to terminate delivery of fuel. Some flow of fuel takes place by way of the grooves 42 and 41 to the fuel inlet 22 but this flow of fuel is restricted by the fact that the piston member 27 is in its retracted position. When the fuel pressure falls sufficiently the piston 27 returns to the seated position as shown in the drawing and the restriction to the flow of fuel during any further inward movement of the pumping plunger 12 is removed. When the plunger 12 moves outwardly fuel can flow along the grooves 40, 41 and 42, to the passage 39 and through the spill valve to the inner end of the bore 11. This flow of fuel because the piston member is in its seated position, is substantially unrestricted and the bore is completely filled with fuel before the plunger is next moved inwardly.

In the retracted position of the piston member the end face is in sealing engagement with the adjacent end face of the spring housing 21 and the piston member will tend to remain in its retracted position at least whilst the valve member of the nozzle is moving into engagement with its seating.

In the example described the flow of fuel when the spill valve is open, takes place by way of the grooves 41 and 42. There is therefore no flow of fuel through the spring chamber 25. If however the groove 42 is omitted and replaced by a drilling which opens into the cylinder 26 and which communicates with the spring chamber, the flow of fuel will take place through the spring chamber.

In the example the increase in fuel pressure in the spring chamber which takes place when the spill valve 32 is opened, acts on the end of the valve member of the nozzle 15. If desired the spring abutment 23 can be modified to form a piston with the wall of the spring chamber 25. Alternatively the spring abutment 31 can be so modified and the passage 39 connected to the spring chamber above the abutment. As a result of this modification the increase of fuel pressure effects an increase in the force exerted by the spring 24 on the valve member.

A leakage groove 45 is formed in the wall of the bore 11 and this is connected by a passage 46 to a lateral outlet 47 defined by the cap nut 21. This outlet is connected to a drain channel formed in the wall of the bore in the engine cylinder head of the associated engine.

I claim:

1. A fuel injection system for supplying fuel to a cylinder of an internal combustion engine, the system comprising a pumping plunger slidable in a bore, the plunger in use being urged inwardly towards one end of said bore to displace fuel therefrom, by an engine driven cam, a fuel injection nozzle including a fuel pressure actuated valve member which is lifted from a seating by the action of fuel under pressure in a nozzle inlet passage thereby to allow flow of fuel from said nozzle inlet passage through an outlet, said nozzle inlet passage communicating with said one end of the bore, a spring biasing the valve member into engagement with the seating, a piston member slidable within a cylinder and serving as an abutment for said spring, a further passage opening into the one end of the cylinder remote from the spring, said further passage communicating with said one end of the bore, said piston member being movable from a first position at said one end of the cylinder to a second position at the other end of the cylinder to increase the force exerted by the spring on the valve member, and valve means operable by the piston member which limits the end area of the piston member exposed to the fuel pressure in said further passage when the piston member is in the first position and a spill valve having a first flow connection to said one end of the bore and a second flow connection to a drain, wherein the second flow connection of the spill valve is connected to the drain by way of a restrictor which is formed by the piston member and the cylinder when the piston member is in the second position, the fuel pressure which is developed between the spill valve and the restrictor when the spill valve is opened, being applied to the valve member of the fuel injection nozzle in order to assist the action of the spring.

2. A fuel injection system as claimed in claim 1, wherein the valve means comprises a projection carried by the piston member and engageable with a seating defined around an end of the further passage.

3. A fuel injection system as claimed in claim 1, wherein the second flow connection communicates with a chamber within which the spring is located, the fuel pressure within the chamber acting upon a surface associated with the valve member to assist the spring.

4. A fuel injection system as claimed in claim 1, wherein the restrictor communicates with the second flow connection by way of a first groove, and communicates with a fuel reservoir by way of a second groove, the restrictor limiting the rate of fuel flow from the first groove to the second groove when the piston member occupies its second position.

5. A fuel injection system as claimed in claim 1, wherein the restrictor does not act to restrict the rate of fuel flow between the drain and the second flow connection when the piston member occupies its first position.

* * * * *